United States Patent [19]

Kremer

[11] 4,296,782

[45] Oct. 27, 1981

[54] DOUBLE-LIFT OPEN-SHED JACQUARD MACHINE

[75] Inventor: Hubert Kremer, Grefrath, Fed. Rep. of Germany

[73] Assignee: Maschinenfabrik Carl Zangs Aktiengesellschaft, Krefeld, Fed. Rep. of Germany

[21] Appl. No.: 88,381

[22] Filed: Oct. 26, 1979

[30] Foreign Application Priority Data

Oct. 27, 1978 [DE] Fed. Rep. of Germany ..... 2846792

[51] Int. Cl.[3] ..... D03C 3/06; D03C 3/30

[52] U.S. Cl. ..... 139/65

[58] Field of Search ..... 139/59, 60, 61, 62, 139/63, 64, 65

[56] References Cited

U.S. PATENT DOCUMENTS 4,067,363 1/1978 Keim ..... 139/65

FOREIGN PATENT DOCUMENTS 2507488 8/1976 Fed. Rep. of Germany ..... 139/65

2326499 4/1977 France ..... 139/59

*Primary Examiner*—Henry Jaudon

*Attorney, Agent, or Firm*—Martin A. Farber

[57] ABSTRACT

A double-lift open-shed Jacquard machine with two lifting bars which are movable in opposite directions to each other and pass each other, and with flat-bar lifters which can be controlled by main needles whose maximum moment of resistance lies parallel to the direction of movement of the main needles and which have two main projections associated with the movable knives, a holder-up projection associated with a fixed upper-shed knife, and at the lower end an engagement point for a harness cord. The two main projections, the holder-up projection, and the engagement point, for the harness cord lie on a straight line as seen crosswise to the direction of movement of the main needles, and the holder-up projection stands off from the flat bar lifter transversely to the direction of movement of the main needles.

11 Claims, 5 Drawing Figures

DOUBLE-LIFT OPEN-SHED JACQUARD MACHINE

The present invention relates to a double-lift open-shed Jacquard machine having two griff boxes which are movable in opposite directions to and pass each other, and having flat-bar lifters which can be controlled by main needles whose maximum moment of resistance lies parallel to the direction of movement of the main needles and which have two main noses associated with the movable knives, a holder-up nose associated with a fixed upper-shed knife, and a point of attachment at their lower end for a harness cord.

Double-life open-shed Jacquard machines having lifters developed with two legs or one leg made of wire or flat steel are known. The lifters are provided at their upper end with two main noses for attachment in oppositely movable griff boxes and in the lower region with a holding-up nose for fixing their upper-shed position on a fixed upper shed knife. At the lower end of the lifters attachment devices for the fastening of a harness cord are provided.

All known lifters, even when developed as flat-bar lifters, have the disadvantage that the direction of force, as seen transverse to the direction of movement of the main needles, does not form a straight line between the main noses, the holder-up nose and the point of attachment for the harness cord. As a rule, the two main noses and the holder-up nose lie at different distances away from an imaginary central longitudinal line while the point of attachment for the harness cord lies on this central longitudinal line. Accordingly different greater or lesser moments act on the flat bar lifter they being dependent on the one hand on the force of the harness pull and on the other hand on the distances of the principal noses and the holding-up nose from each other and from the imaginary central longitudinal line. In addition to this, in the case of all known lifters including flat-bar lifters, the holder-up noses lie towards the front as seen in the direction of movement of the main needles and upon movement upward from the lower shed into the upper shed pass by the upper-shed knife so that the lifters are deflected by an amount equal to the height of the holding-up nose. In this connection, the main needles which are connected in positive (form-locked) manner with the lifters in the control device are moved in positive fashion so that they must have a correspondingly large control clearance.

With an increasing speed of revolution of double-lift open-shed Jacquard machines the problem results of constructing the lifters and guiding them during their movement in such a way that they do not enter into vibration since that could cause errors in leasing-in or weaving errors. One known measure for quieting the lifters consists in strengthening the compression springs which are seated on each main needle and return the lifters to their initial position after they have been actuated. This measure, however, has the drawback that a greater amount of wear occurs and that the energy which must be provided increases. Another measure, known from West German Provisional Patent Auslegeschrift 2,543,810, for quieting the lifters consists in arranging in the path of movement of the principal needles behind a spring frame, a pressing beam which is moved back and forth approximately synchronously with the pressing grid in order to be able positively to guide the main needles on a part of their path between the pressing grid and the pressing beam so that they cannot continue to vibrate. Finally, it is also known to provide a resting plate in addition behind each series of lifters.

All the previously known measures for the quieting of the lifters at higher speeds of revolution have only given partial success inasmuch as the known designs result in a relatively large amount of leasing-in play for the lifters. Proceeding herefrom, the object of the present invention is to develop a double-lift open-shed Jacquard machine while using a flat-bar lifter in such a manner that the flat-bar lifters can be controlled with as little play as possible by the main needles and can be moved with the griff boxes.

In order to acheve this purpose it is proposed that the two main noses, the holding-up nose and the point of attachment for the harness cord be arranged on a straight line as seen transverse to the direction of movement of the main needles and that the holding-up projection or hook be arranged transverse to the direction of movement of the main needles.

A Jacquard machine having a flat-bar lifter developed in accordance with the invention has the advantage that due to the harness pull there is no longer exerted on the flat-bar lifter any moment which would have to be counteracted again by a compression spring arranged on the main needle, and that the upward movement of the flat-bar lifter from the lower shed into the upper shed takes place without exerting on the upper-shed grid any additional movement of deflection which could be transmitted to the main needle. As a result compression springs on the main needles can be made as weak as desired while still compensating for manufacturing tolerances. Furthermore, it is possible to guide the main needles now over their entire path of movement in positive fashion between a pressure grid and a pressing beam. In the final result, therefore, it is possible with a Jacquard machine developed in accordance with the invention to guide the main needles practically without play and to move a flat-bar lifter free of moment with the griff boxes. In this way there are produced very quiet vibration-free reading-in movements which permit extremely high speeds of revolution.

In one practical embodiment, the main noses and the holder-up nose can be punched out of the flat-bar lifter and bent off laterally so that they form at their bottom an oblique surface with a recess behind same for the entrance of a control hook or a holding-up hook. It has furthermore been found to be advisable to arrange the upper-shed knives parallel to the main needles and to provide them on their lower edge with holding-up hooks spaced apart from each other by recesses so that the flat-bar lifter, when moving down from the upper shed into the lower shed, can be passed through between the holding-up hooks by displacement parallel to the upper-shed knife.

However, it is also possible to arrange the upper-shed knife in traditional fashion transverse to the main needles and to provide it, on the rear side wall as seen in the control direction, with holding-up hooks which are spaced apart from each other by recesses and which also permit the controlling of the holding-up nose in the direction of movement of the main needles.

In a Jacquard machine developed in accordance with the invention which has a flat-bar lifter in which the main noses together with the holding-up nose and the point of attachment for the harness cord lie on a middle line as seen transverse to the direction of movement of the main needles, the design of the knives is limited by the condition that the control hooks of adjacent knives are also arranged on a line with each other. For this purpose, the knives of the griff boxes may suitably consist of interconnected hook plates which are provided with control hooks which are bent off in direction towards the main noses of the flat-bar lifters and are provided with control hooks which are spaced from each other. The control hooks can be stamped out of the hook plates and be bent off laterally, they being V-shaped at their upper end which extends parallel to the hook plates. In order to be able to move the main noses of the flat-bar lifter out of the range of movement of the control hooks, the control hooks which lie in the front as seen in the direction of movement of the main needles are spaced so far away from the hook plates that the main noses can be moved past the rear side of said control hooks.

With a Jacquard machine developed in accordance with the invention it is furthermore possible to guide the flat-bar lifters above and below the main needles on guide bars which cross each other so that they can be moved only by the lift of the main needles in the control direction.

Further details, features and advantages of the object of the invention will be evident from the following description of the accompanying drawings in which a preferred embodiment of a Jacquard machine developed in accordance with the invention is diagrammatically shown. In the drawings.

Figure 1:
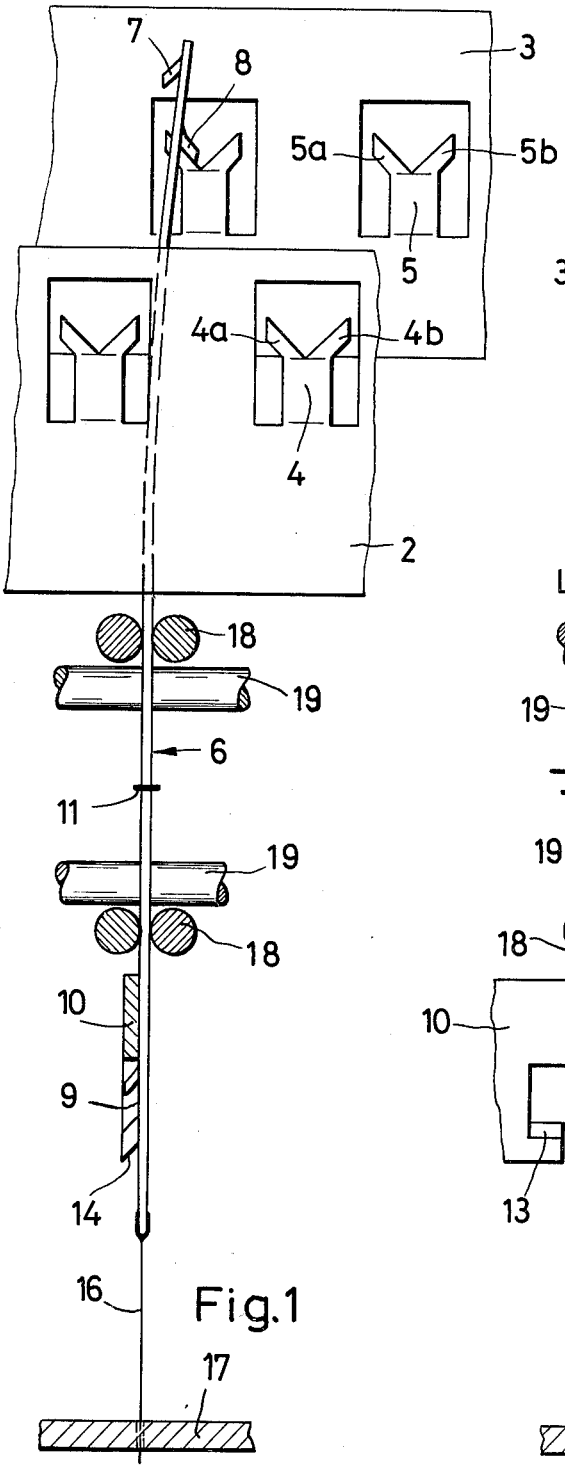
FIGS. 1 and 2 show a first embodiment with control hooks lying on a knife at different heights seen in front view and in side view respectively.
Figure 2:
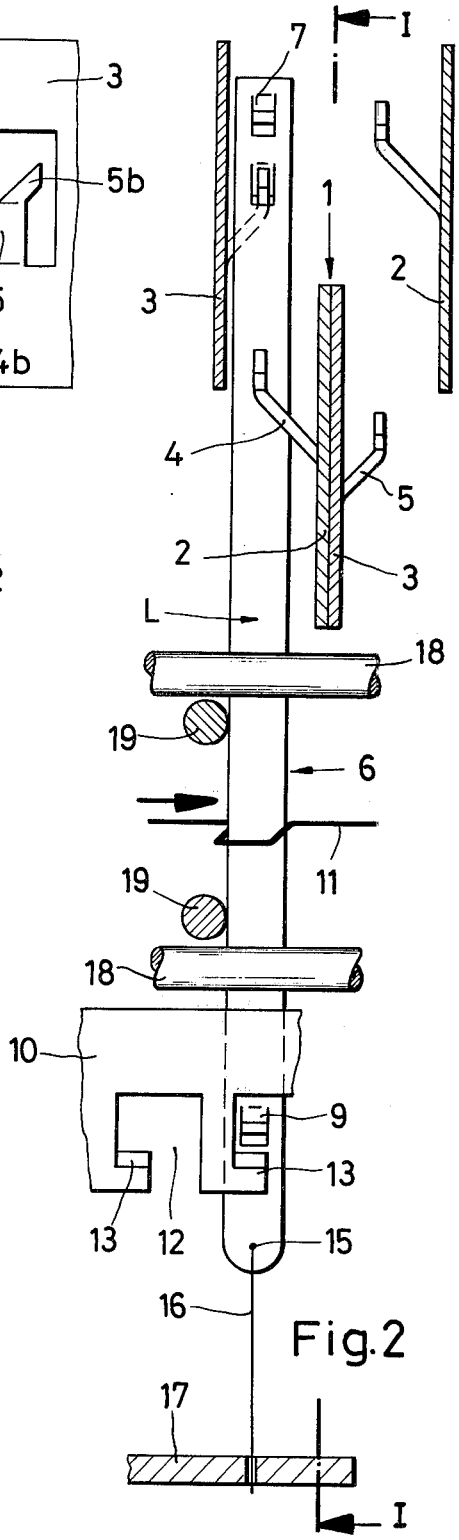

In the embodiment shown in FIGS. 1 and 2, a knife 1 consists of two hook plates 2 and 3 which are attached to each other and out of which control hooks 4 and 5 are punched and bent off laterally. The upper ends of the control hooks 4 and 5 are notched in V-shape, so that in each case there are produced two control hooks 4*a* and 4*b* and 5*a* and 5*b* respectively which point parallel to the longitudinal direction of the knife 1. The distance between the control hooks 4 and the plane of the hook plate 2 is somewhat greater than the distance between the control hooks 5 and the plane of the control plate 3, to which fact reference will be had further below.

With the knives 1 there cooperates a flat-bar lifter 6 which is provided at its upper end with two main noses or projections 7 and 8 spaced apart from each other and, near its lower end, with a holder-up nose or projection 9. The two main noses 7 and 8 are punched out of the flat bar lifter 6 and bent out towards different sides so that they can cooperate with the control hooks 4*a* and 5*b* of adjacent hook plates 2 and 3.

The holder-up nose 9 is also punched out of the flat-bar lifter 6 and bent out laterally. It cooperates with a stationary upper-shed knife which is arranged parallel to the direction of movement of main needles 11 and is provided with holding-up hooks 13 spaced from each other by recesses 12. At its lower edge each holding-up hook 13 is provided with a run-on incline 14.

The two main noses 7 and 8, the holding-up nose 9 and a point of attachment 15 for a harness cord 16 lie on a straight line L. The harness cord 16 is guided through a lifter bottom 17 on which the flat-bar lifter 6 can be supported in the lower shed.

Above and below the main needle 11 which by means of an offset grasps in form-locked manner around the flat-bar lifter 6, intersecting guide bars 18 and 19 are arranged.

Figure 3:
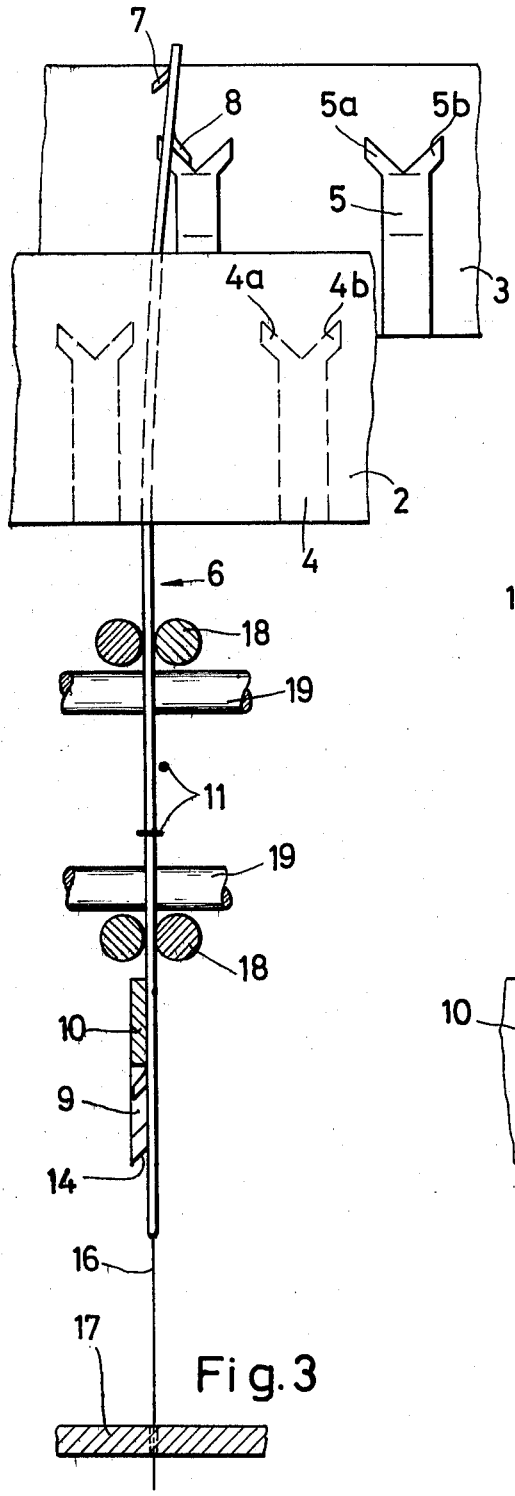
FIGS. 3 and 4 show a second embodiment with control hooks lying on a knife at the same height, seen in front view and in side view respectively.
Figure 4:
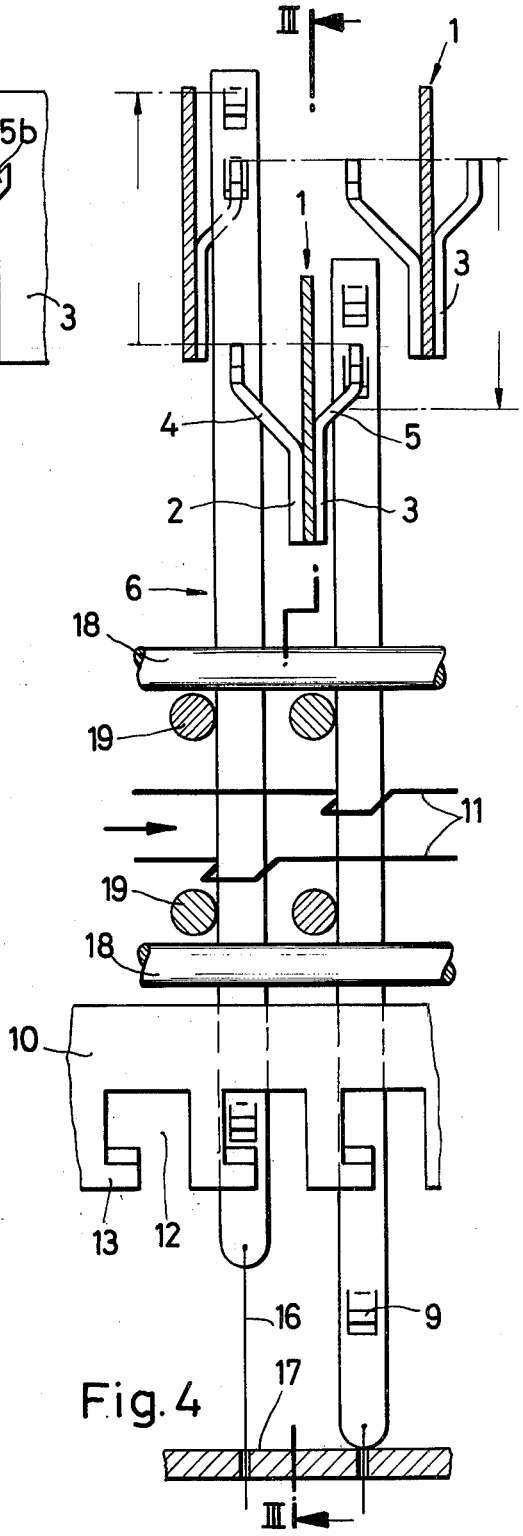

While in the embodiment in accordance with FIGS. 1 and 2 the control hooks 4*a*, 4*b* and 5*a*, 5*b* respectively of a knife 1 are displaced from each other vertically by the distance between the two main noses 7, 8 in the case of the embodiment in accordance with FIGS. 3 and 4 the control hooks 4*a*, 4*b* and 5*a*, 5*b* respectively of a knife 1 are at the same height which is advisable for the development of a V-shed when the knives 1 are swung around their longitudinal axis in their upper-shed positionor upper-shed and lower-shed positions. The distance between the main noses 7, 8 is compensated for in this embodiment by a staggering of the knives 1 which, however, again have the same lift. Otherwise this embodiment is the same as the embodiment described above so that the same parts have also been provided with the same reference numbers.

Figure 5:
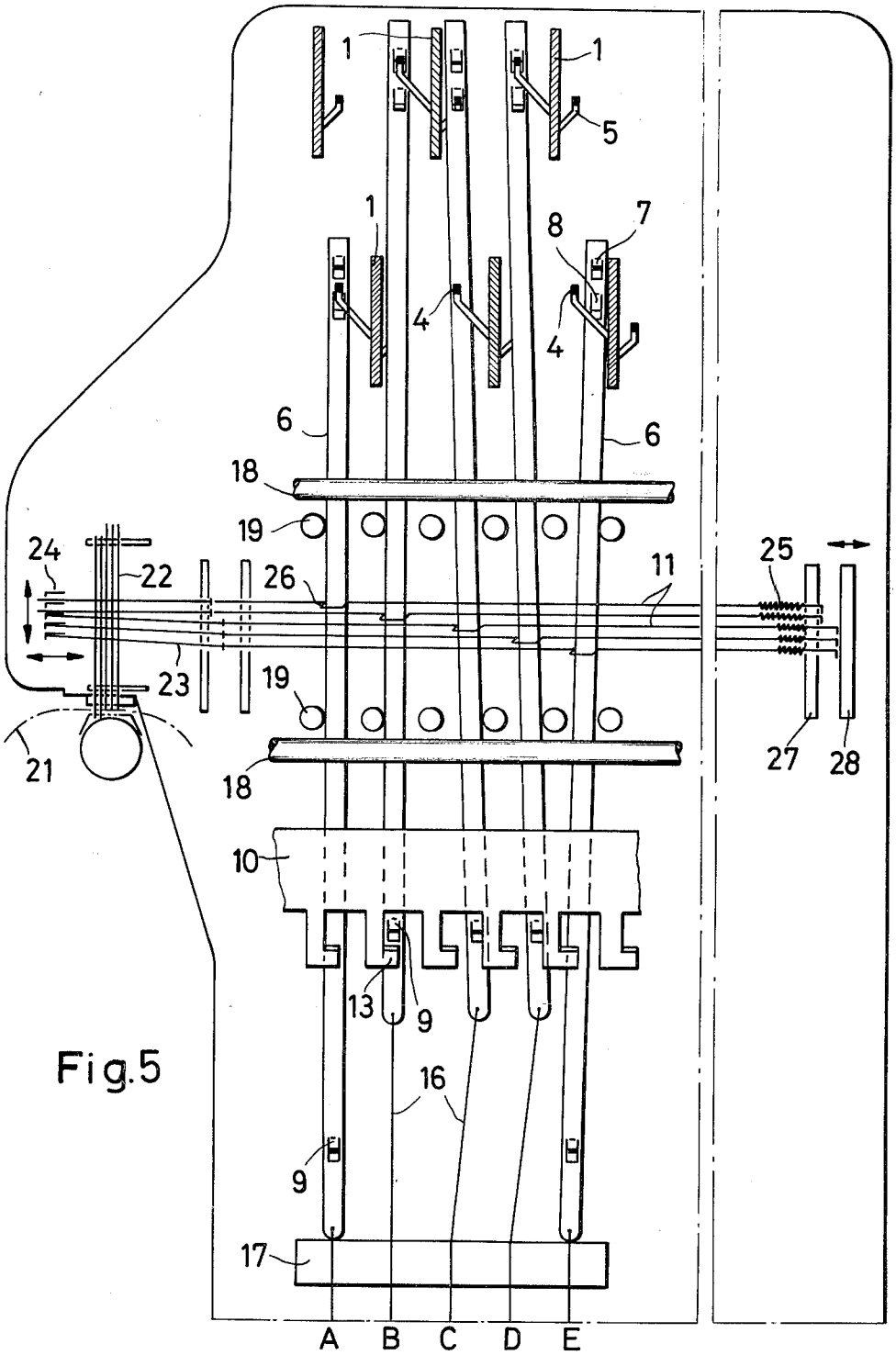
FIG. 5 shows diagrammatically the construction of a double-lift open-shed Jacquard machine having five flat-bar lifters shown in different control positions, seen in side view.

The function of a double-lift open-shed Jacquard machine developed in accordance with the invention will be described below on basis of the schematic showing given in FIG. 5. In order to facilitate the description of the operation, the different positions of the flat-bar lifters 6 are designated in successive order by the letters A, B, C, D and E.

The flat-bar lifters 6 are in known manner controlled by a pattern card 21 via a needle mechanism which consits of feeler needles 22, head needles 23 and the main needles 11 and has a pressing grid 24 moved along a curve in the direction of the intersecting double-ended arrows.

For position A of the flat-bar lifter 6 the corresponding feeler needle 22 has found a hole in the pattern card 21 so that the head needle 23 is not pushed off by the pressing grid 24 and therefore remains in position of rest together with the corresponding main needle 22. The flat-bar lifter 6 is thus not pushed off and it is therefore grasped by a lower knife 1 and pulled out of the lower-shed position upwards into the upper shed position which corresponds to position B. Upon the lowering of the knife 1 from which the flat-bar lifter is suspended, it is placed with its holding-up nose 9 on a holding-up hook 13 of the upper shed knife 10. In this position it can remain in the upper shed.

When the flat bar lifter 6 is moved out of the lower shed into the upper shed, the holder-up nose 9 moves past the holding-up hook 13 of the upper shed knife 10 without moving the main needle 11 since the flat-bar lifter 6 is merely deflected somewhat transverse to the direction of movement of the main needle 11. In this connection a compression spring 25 can, via the main needle 11 and its offset 26, hold the flat-bar lifter 6 resting against the guide bars 19.

In position C, the feeler needle 22 of the flat bar lifter 6 which is in the upper-shed position has not found any hole in the pattern card 21 so that the flat-bar lifter 6 is pressed off by the pressing grid 24 over the pre-needle mechanism and the holding-up nose 9 is thus pressed out of the range of the holding-up hook 13. The flat-bar lifter 6 can then be conducted into the lower shed from position C with the knife 1.

In position D, the flat bar lifter 6 has been brought by the knife 1 into the upper-shed position. Since, however, the corresponding feeler needle 22 has not found any hole in the pattern card 21, the flat bar lifter 6 has been pressed off via the pre-needle mechanism by the pressing grid 24. In this way the holding-up nose 9 remains free from the holding-up hook 13 so that the flat-bar lifter 6 is again lowered immediately into the lower shed, which corresponds to position A.

In position E, the flat-bar lifter 6 is in the lower-shed position and has been placed on the lifter bottom 17. The corresponding feeler needle 22 has not found any hole in the pattern card 21 so that the flat-bar lifter 6 has been pressed off via the pre-needle mechanism by the pressing grid 24. In this way the upper end of the flat-bar lifter 6 has been swung to such an extent that the main nose 7 comes behind the control hook 4 and thus comes out of engagement with the control hook 4*a* when the knife 1 is moved from the lower-shed position into the upper-shed position. A flat-bar lifter 6 in position E therefore remains in the lower shed.

Behind a spring frame 27 on which the compression springs 25 arranged on the main needles 11 rest there is arranged a pressing beam 28 which rests against the ends of the main needles 11 and is moved back and forth synchronously with the pressing grid 24. The distance between the pressing beam 28 and the ends of the main needles 11 can be so slight that only manufacturing tolerances can be compensated for. In this way there is obtained a practically form-locked movement between the pressing grid 24, the head needles 23, the main needles 11 and the pressing beam 28 over the entire course of movement of the main needles, which makes possible a vibration-less low-oscillating return movement of the flat-bar lifters 6 after the holding-up noses 9 have passed the holding-up hooks 13.

I claim:

1. In a double-lift open-shed Jacquard machine with two lifting bars which are movable in opposite directions relative to each other and pass each other, and with flat-bar lifters which can be controlled by main needles, whose maximum moment of resistance is parallel to the direction of movement of the main needles, and which have two main projections associated with the movable knives, a holder-up projection assoicated with a fixed upper-shed knife, and at the lower end an engagement point for a harness cord, the improvement wherein a flat-bar lifter has two main projections, a holder-up projection and an engagement point for the harness cord, said two main projections, said holder-up projection and said engagement point lie on a straight line oriented crosswise to the direction of movement of the main needles, said holder-up projection is positioned adjacent the flat-bar lifter in a direction transverse to the direction of movement of the main needles.

2. The Jacquard machine according to claim 1, wherein said main projections and said holder-up projection are punched out of the flat-bar lifter and bent off laterally.

3. The Jacquard machine according to claim 1, wherein the upper-shed knife extends parallel to the main needles, and on a side wall thereof which is rearward in a control direction the upper-shed knife has a plurality of said holding-up projection constituting holding-up hooks and defines recesses therebetween, said holding-up hooks are spaced apart from each other by said recesses.

4. The Jacquard machine according to claim 1, further comprising a movable knife has first control hooks disposed frontward in a control direction and second control hooks arranged behind said movable knife in the control direction, said first control hooks have a larger spacing, by the width of the main projections, from the movable knife than said second control hooks.

5. The Jacquard machine according to claim 1, wherein the upper-shed knife has a plurality of said holding-up projection constituting holding-up hooks and defines recesses therebetween, said holding-up hooks spaced apart from each other by said recesses.

6. The Jacquard machine according to claim 5, wherein said holding-up hooks of the upper-shed knife respectively have a lower edge forming a run-on inclination.

7. The Jacquard machine according to claim 5, wherein the surfaces of said holder-up projection and said holding-up hooks are beveled parallel to one another.

8. The Jacquard machine according to claim 1, further comprising a plurality of movable knives each comprising hook plates which are connected with another, said hook plates are formed with control hooks spaced from one another and angled-off in a direction towards the main projections of the flat-bar lifter.

9. The Jacquard machine according to claim 8, wherein said control hooks are stamped out of said hook plates and are bent-off laterally.

10. The Jacquard machine according to claim 8, wherein said control hooks are formed V-shaped at an upper end, said upper end extends parallel to said hook plates and said control hooks each form control hook portions pointing in opposite directions.

11. The Jacquard machine according to claim 1, further comprising guide bars abutting the flat-bar lifters, above and below the main needles, said guide bars are arranged crosswise to each other.

* * * * *

UNITED STATES PATENT AND TRADEMARK OFFICE

CERTIFICATE OF CORRECTION

PATENT NO. : 4,296,782

DATED : October 27, 1981

INVENTOR(S) : Hubert Kremer

It is certified that error appears in the above—identified patent and that said Letters Patent is hereby corrected as shown below:

The title page and the figures 1 and 2 should appear as shown on the attached sheets.

Signed and Sealed this

*Eleventh* Day of *May 1982*

[SEAL]

*Attest:*

GERALD J. MOSSINGHOFF

*Attesting Officer*

*Commissioner of Patents and Trademarks*

United States Patent [19]

Kremer

[11] 4,296,782

[45] Oct. 27, 1981

[54] DOUBLE-LIFT OPEN-SHED JACQUARD MACHINE

[75] Inventor: Hubert Kremer, Grefrath, Fed. Rep. of Germany

[73] Assignee: Maschinenfabrik Carl Zangs Aktiengesellschaft, Krefeld, Fed. Rep. of Germany

[21] Appl. No.: 88,381

[22] Filed: Oct. 26, 1979

[30] Foreign Application Priority Data

Oct. 27, 1978 [DE] Fed. Rep. of Germany ..... 2846792

[51] Int. Cl.[3] ..... D03C 3/06; D03C 3/30

[52] U.S. Cl. ..... 139/65

[58] Field of Search ..... 139/59, 60, 61, 62, 139/63, 64, 65

[56] References Cited

U.S. PATENT DOCUMENTS 4,067,363 1/1978 Keim ..... 139/65

FOREIGN PATENT DOCUMENTS 2507488 8/1976 Fed. Rep. of Germany ..... 139/65

2326499 4/1977 France ..... 139/59

*Primary Examiner*—Henry Jaudon

*Attorney, Agent, or Firm*—Martin A. Farber

[57] ABSTRACT

A double-lift open-shed Jacquard machine with two lifting bars which are movable in opposite directions to each other and pass each other, and with flat-bar lifters which can be controlled by main needles whose maximum moment of resistance lies parallel to the direction of movement of the main needles and which have two main projections associated with the movable knives, a holder-up projection associated with a fixed upper-shed knife, and at the lower end an engagement point for a harness cord. The two main projections, the holder-up projection, and the engagement point, for the harness cord lie on a straight line as seen crosswise to the direction of movement of the main needles, and the holder-up projection stands off from the flat bar lifter transversely to the direction of movement of the main needles.

11 Claims, 5 Drawing Figures

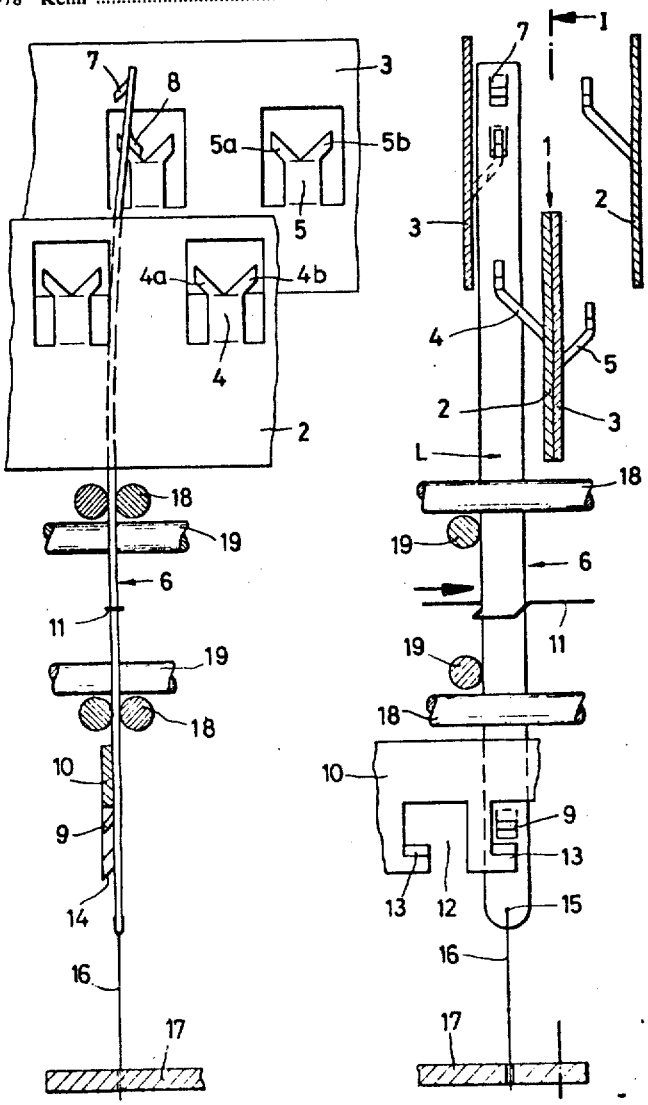

UNITED STATES PATENT AND TRADEMARK OFFICE

CERTIFICATE OF CORRECTION

PATENT NO. : 4,296,782

DATED : October 27, 1981

INVENTOR(S) : Hubert Kremer

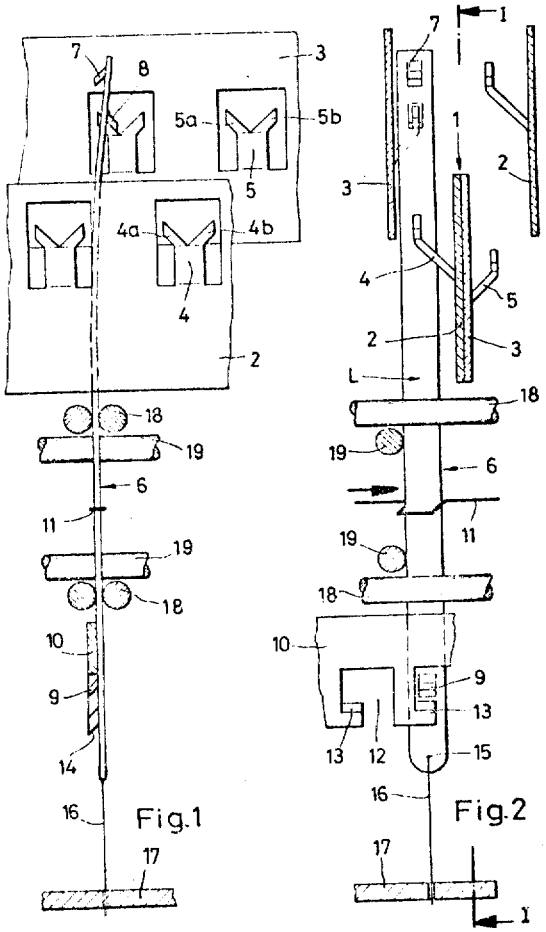

It is certified that error appears in the above—identified patent and that said Letters Patent is hereby corrected as shown below: